United States Patent [19]

Riddick et al.

[11] 4,121,600

[45] Oct. 24, 1978

[54] ORAL HYGIENE DISPENSER

[76] Inventors: William E. Riddick; Patricia R. Riddick, both of 144-46 77th Rd., Queens, N.Y. 11367

[21] Appl. No.: 742,644

[22] Filed: Nov. 17, 1976

[51] Int. Cl.[2] ..... A45D 40/08

[52] U.S. Cl. ..... 132/79 R

[58] Field of Search ..... 132/79 F, 80, 84, 83; 312/43, 207; 211/65, 75; 298/311

[56] References Cited

U.S. PATENT DOCUMENTS

| | | | |
|---|---|---|---|
| 1,485,850 | 3/1924 | Hollander | 132/84 D |
| 1,493,097 | 5/1924 | Blood | 132/79 F |
| 1,615,571 | 1/1927 | Crecelius | 132/84 D |
| 1,673,007 | 6/1928 | Kaiser | 312/43 X |
| 1,713,379 | 5/1929 | Fromwiller | 132/84 D |
| 2,401,318 | 6/1946 | Robinson et al. | 132/84 D |
| 2,808,841 | 10/1957 | Bourdon | 132/83 R |
| 3,277,901 | 1/1964 | McElhiney | 132/80 R |

*Primary Examiner*—G.E. McNeill

[57] ABSTRACT

An oral hygiene dispenser comprising a housing having a bottom wall, oppositely disposed upstanding front and rear walls with a pair of spaced apart upstanding end walls intermediate the front wall and the rear wall. The upstanding walls joined to the bottom wall at one end thereof and terminating in an open upper end having a cover adapted to enclose the open end of the housing. A first partition in the housing extends between the front wall and the rear wall for forming a fluid compartment to dispense fluid therefrom, with a viewing aperture operatively associated with the front wall in overlapping position to the fluid compartment such that the level of fluid in the fluid compartment may be immediately obtained by visual means. A spigot is mounted on the front wall in communicating relationship with the fluid compartment so as to permit manual control for the dispensing of selected amounts of fluid therefrom. A second partition extends between the first partition and one of the end walls so as to obtain a toothbrush and toothpaste containing compartment adjacent the front wall and a storage compartment adjacent the rear wall. A door is hingeably mounted on the front wall to gain access to the toothbrush and toothpaste compartment. A rack extends transversely across the toothbrush and toothpaste compartment to releasably retain a toothbrush at substantially each end thereof. Supporting means in the toothbrush and toothpaste compartment is provided for maintaining a tube of toothpaste in a vertically extending position by means of the cap on the tube, and a cup dispenser is secured to one of the end walls for retaining a supply of disposable cups, such that the user of the oral hygiene dispenser has ready access to the necessary implements required to properly maintain the oral cavity.

40 Claims, 7 Drawing Figures

ORAL HYGIENE DISPENSER

BACKGROUND OF THE INVENTION

1. Field of the Invention

The present invention relates to a novel oral hygiene dispenser unit having provisions for dispensing and making readily available articles and preparations such as mouth wash, toothpaste and disposable cups that would be used on a daily basis in properly maintaining the oral cavity.

2. Description of the Prior Art

A variety of bathroom units have been proposed in the prior art to aid the user for oral hygiene purposes. The prior art units as illustrated in U.S. Pat. Nos. 1,139,134; 1,624,015; 1,666,564; 1,894,488; 2,313,184; 2,411,196; 2,939,755; and 3,187,757 have been found deficient for various reasons. It is believed that the present invention advances the art and provides a novel combination that will aid the user in proper maintenance of the oral cavity.

In contrast to the disclosures in the above patents, the present invention provides a device which facilitates the ready access by the user to the toothpaste, toothbrush, as well as mouthwash that would be used on a daily basis. The device further provides for the dispensing of disposable cups which have gained market acceptance and are used by millions of individuals on a daily basis.

OBJECTS OF THE INVENTION

It is the primary object of the present invention to provide a new and novel oral hygiene dispenser that is easily utilized by the consumer.

It is another object of the present invention to provide an oral hygiene dispenser unit that contains separate compartments for a fluid such as a mouthwash, a compartment for storing the toothpaste and toothbrushes, as well as a storage compartment which may contain an extra supply of cups or mouthwash.

It is a more particular object of the present invention to provide an oral hygiene dispenser unit that is readily mounted on a wall in a bathroom, and that has a spigot on the front wall thereof to dispense desired amounts of mouthwash into disposable cups which are contained in a holder mounted on the unit.

It is yet a further object of the present invention to provide an oral hygiene dispenser unit having a refillable reservoir for containing a mouthwash or the like, with means for visually detecting the level of fluid in the reservoir.

It is a more particular object of the present invention to provide a new and improved unit for oral hygiene use in which the tube of toothpaste is readily supported and may be removed through an access door on the unit.

SUMMARY OF THE INVENTION

An oral hygiene dispenser comprising a housing having a bottom wall, oppositely disposed upstanding front and rear walls with a pair of spaced apart upstanding end walls intermediate the front wall and the rear wall. The upstanding walls joined to the bottom wall at one end thereof and terminating in an open upper end having a cover adapted to enclose the open end of the housing. The cover being hingeably mounted on the rear wall for movement between a closed postion, to an open position in which access to the housing is obtained.

A first partition in the housing extends between the front wall and the rear wall for forming a fluid compartment having a reservoir mounted in the fluid compartment for containing selected amounts of fluid. A viewing aperture is operatively associated with the front wall in overlapping position to the fluid compartment such that the level of fluid in the reservoir may be immediately obtained by visual means. The reservoir being transparent to permit viewing of the level of fluid therein through the viewing aperture. A spigot is mounted on the front wall in communicating relationship with the reservoir so as to permit manual control for the dispensing of selected amounts of fluid therefrom.

A second partition extends between the first partition and one of the end walls so as to obtain a toothbrush and toothpaste containing compartment adjacent the front wall and a storage compartment adjacent the rear wall. A door is hingeably mounted on the front wall to gain access to the toothbrush and toothpaste compartment. The door having a transparent window therein to view the contents of the toothbrush an toothpaste compartment.

A rack extends transversely across the toothbrush and toothpaste compartment to releasably retain a toothbrush at substantially each end thereof. The rack comprising a rearwardly extending horizontal ledge having oppositely disposed distal ends. The distal ends extend between the second partition and one of the end walls. A pair of forwardly extending gripping elements extend inwardly from each distal end in spaced relationship to the horizontal ledge. Each of the gripping elements are adapted to releasably retain a toothbrush in mounted relationship thereto.

Supporting means in the toothbrush and toothpaste compartment for maintaining a tube of toothpaste in a vertically extending position by means of the cap on the tube is provided. The supporting means compises a horizontally extending plate in spaced relationship to the bottom wall having an aperture in the plate adapted to receive the cap of the toothpaste tube therein, so as to support the upper end of the cap on the bottom wall with the aperture confining the other end of the cap such that the tube is retained during storage thereof in the vertical extending position.

A cup dispenser secured to one of the end walls for retaining a supply of disposable cups is provided such that the user of the oral hygiene dispenser has ready access to the necessary implements required to properly maintain the oral cavity, and mounting means is operatively associated with the rear wall so as to permit the securement of the dispenser to a wall.

BRIEF DESCRIPTION OF THE DRAWINGS

The foregoing and other objects, features and advantages of the present invention will become readily apparent to those skilled in the art from a reading of the detailed description hereinafter, when considered in conjunction with the accompanying drawings, wherein.

DETAILED DESCRIPTION OF THE DRAWINGS

Figure 1:
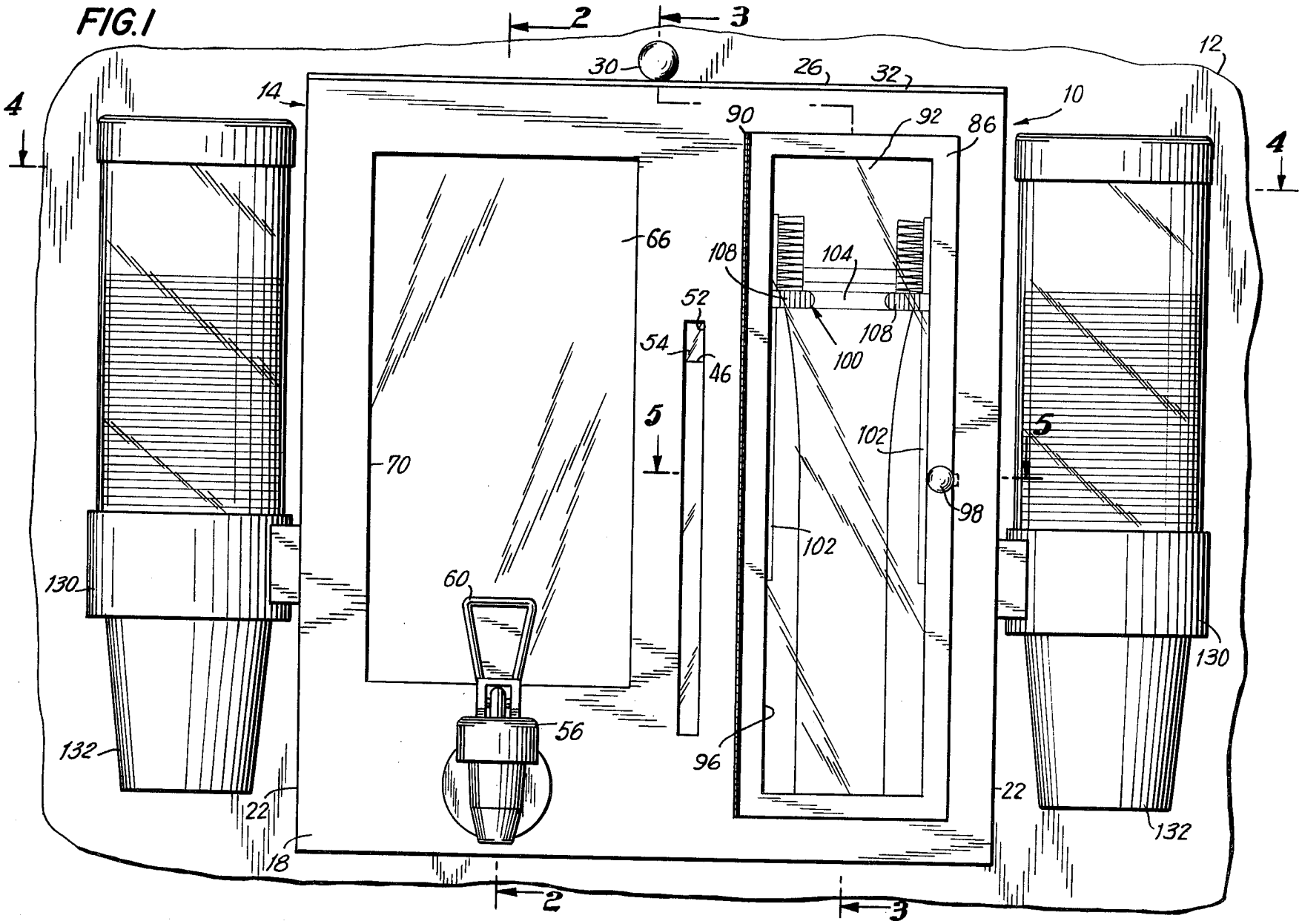
FIG. 1 is a front plan view of the oral hygiene dispenser unit in accordance with the present invention.

Referring now to the drawings and, more particularly to FIGS. 1 through 6 thereof, there is shown a first embodiment of the present invention of an oral hygiene dispenser unit 10 that is designed to be mounted on a wall 12 in the bathroom, or other selected room of a home, hotel, etc. The unit 10 may be used in industrial locations for the convenience of the employees if so desired. The unit 10 includes a housing 14 having a bottom wall 16, oppositely disposed upstanding front and rear walls 18 and 20, respectively. Intermediate the front wall 18 and rear wall 20 are disposed a pair of end walls 22. The upstanding walls 18, 20, and 22 are joined to the bottom wall 16 at one end thereof. The other end of the upstanding walls 18, 20, and 22 terminate in an open upper end 24. The open upper end 24 permits access to the interior of the housing 14.

Figure 3:
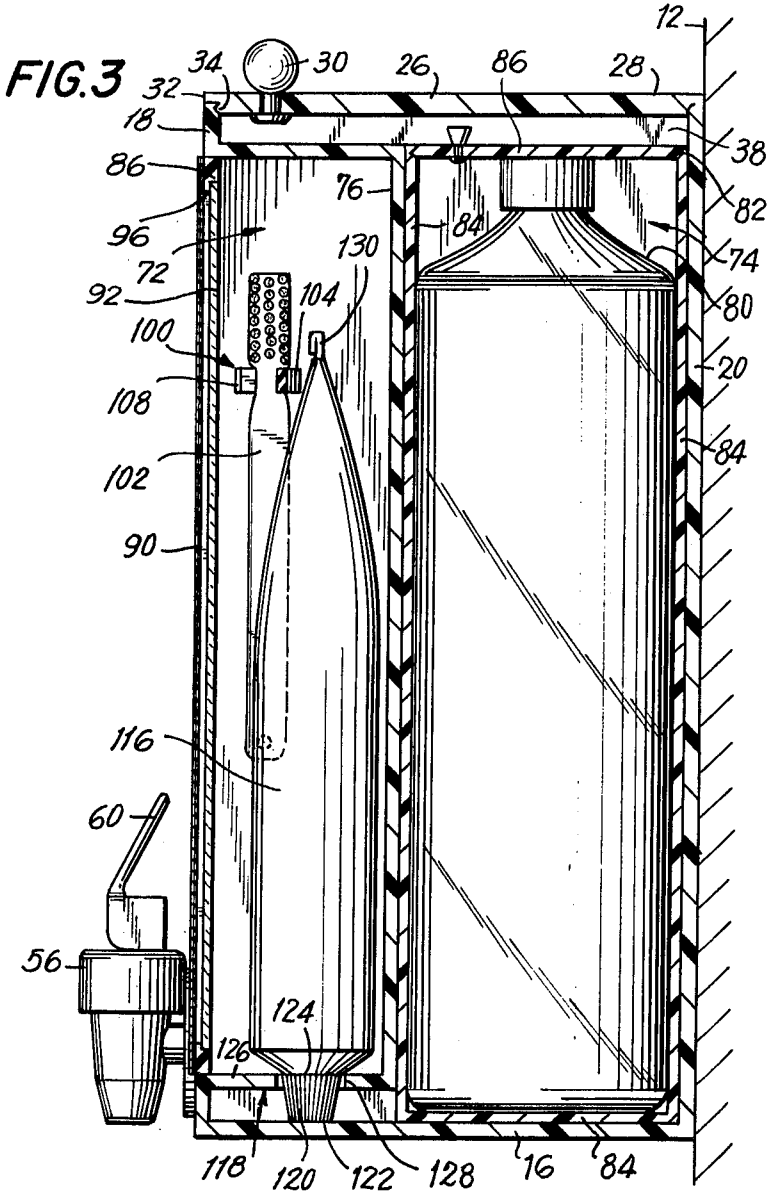
FIG. 3 is a sectional view taken on the line 3—3 of FIG. 1.

A cover 26 is provided and adapted to enclose the open end 24. The cover 26 may be hingeable mounted along the rear end 28 thereof to the rear wall 20. The cover 26 being capable of movement between a closed position, as seen in FIG. 3, to an open position in which access to the housing 14 is obtained. A handle 30 may be provided on the cover 26 adjacent the front end 32 thereof. The handle facilitates the movement of the cover 26. To maintain the cover 26 in its closed position, a catch 34 may be provided to obtain a snap fit with the front wall 18.

A fluid compartment 36 is provided within the housing 14 and may be formed by a first partition 38 that extends vertically between the front wall 18 and rear wall 20. Preferably a reservoir 40 is positioned within the fluid compartment 36. The reservoir 40 may be fabricated from a transparent material and refillable by the user. The reservoir 40 may include a bottom 42 and upstanding walls 44 that are dimensioned to fit within the fluid compartment 36, and contain selected amounts of fluid 46. The fluid 46 is preferably a mouthwash, or other medicament, to be used on a daily basis by the person making use of the cabinet or unit 10.

The reservoir 40 includes a closure or top 48 removeably secured to the upper end thereof to permit filling of the reservoir 40 from time to time as required with the fluid 46. Accordingly, the cover 26 is opened by overcoming the force of the lock or catch 34 so that access to the reservoir 40 is obtained by removal of the closure 48. The closure 48 may have a knob 50 to facilitate the removal from the position illustrated in FIG. 2. When the closure 48 is removed, the mouthwash fluid 46 may be replenished.

To advise the user of the oral hygiene dispenser when refilling is required, a viewing aperture 52 is provided on the front panel 18. The viewing aperture 52 is in overlapping position to the fluid compartment 36 and the reservoir 40 so that the level of fluid in the reservoir 40 may be immediately obtained by visual means. A clear plate or window 54 may be mounted adjacent the viewing aperture 52 to prevent dust from entering the fluid compartment 36.

Figure 2:
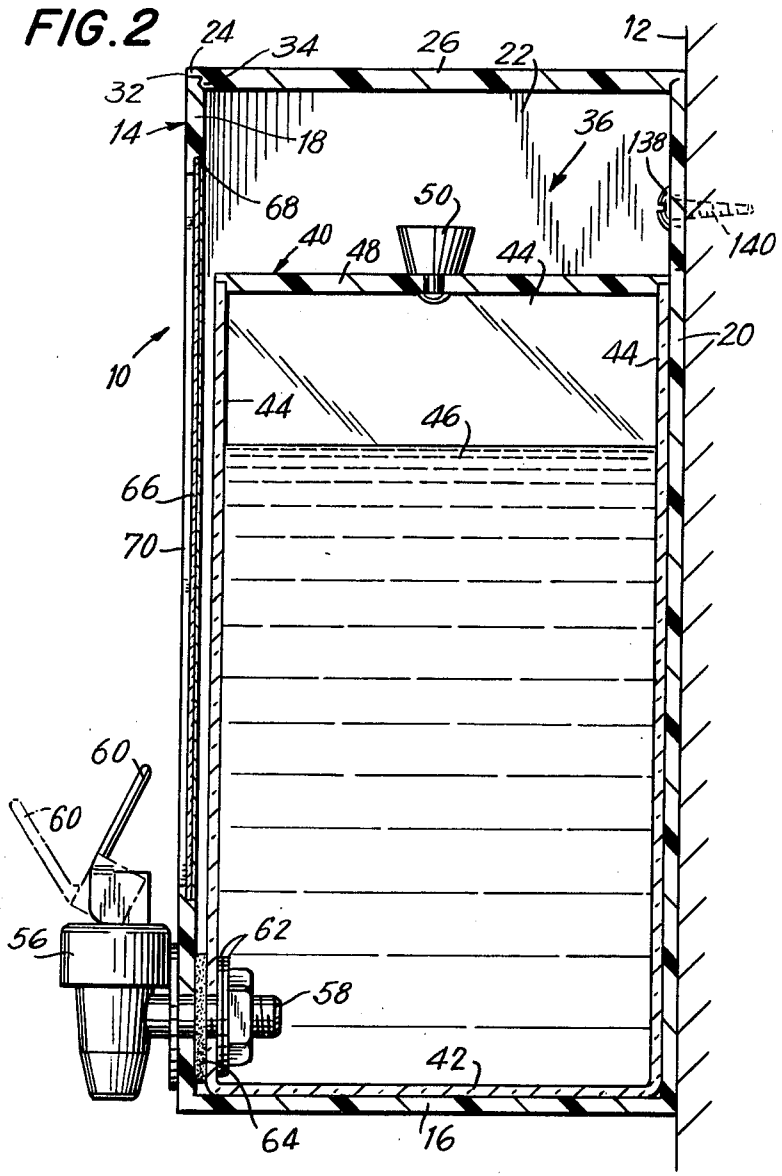
FIG. 2 is a sectional view taken on the line 2—2 of FIG. 1.

A spigot or faucet 56 is mounted on the front wall 18 and in communicating relationship with the reservoir 40 as by a valve stem 58 as illustrated in FIG. 2. A control lever 60 forms part of the spigot 56 to permit manual control for the dispensing of selected amounts of fluid 46 from the reservoir 40. Washers 62, and sealing washer 64 may be mounted on the valve stem 58 in a conventional manner to provide the necessary liquid tight seal that is required.

To further facilitate use of the oral hygiene device 10 there is provided a mirror 66 on the front wall 18. The mirror 66 may be centrally disposed with respect to the fluid compartment 36 and be contained in a recess 68 on the inner side of front wall 18. A cut out or recess opening 70 may be provided on the front wall 18 which is slightly smaller than the size of the mirror 66. The mirror 66 is mounted adjacent to the viewing aperture 52.

Figure 4:
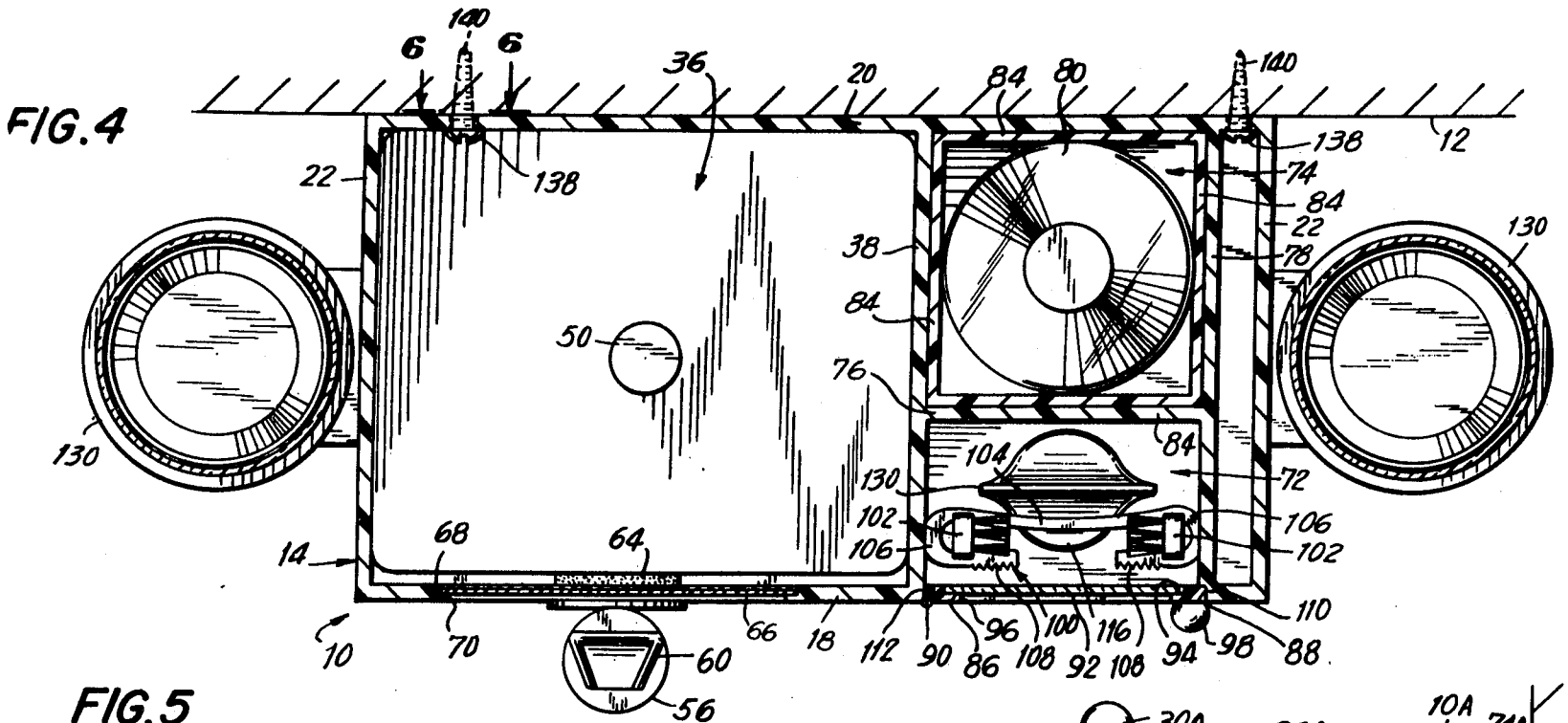
FIG. 4 is a sectional view taken on the line 4—4 of FIG. 1.

The housing 14 further includes a toothbrush and toothpaste containing compartment 72 and a storage compartment 74, adjacent thereto. A second partition 76 is provided that extends from the first partition 38 and towards one of the end walls 22. As illustrated in FIG. 4 an intermediate end wall 78 may be provided in spaced relationship to end wall 22. The toothbrush and toothpaste containing compartment 72 is formed adjacent the front wall 18 and the storage compartment 74 adjacent the rear wall 20.

The storage compartment 74 may be utilized for receiving therein a container 80 of mouthwash fluid for filling the reservoir from time to time. The storage compartment 74 may include an inner lining 82 which has walls 84 that fit within the confines of the storage compartment 74. The inner liner 82 may include a lid 86, as illustrated in FIG. 3 that may be open for removal of the container 80 therein.

To gain access to the toothbrush and toothpaste compartment 72, a door 86 is hingeably mounted on the front wall 18 relative to an opening 88 in the front wall 18. A hinge 90 may extend vertically along one edge of the door 86. To permit viewing of the contents of compartment 72, a transparent window 92 may be mounted within a recess 94 in the door 86. The door 86 includes a viewing aperture 96 behind which the transparent window 92 is mounted. The door 86 may have a knob or handle 98 thereon to aid the user in opening and closing of same.

The toothbrush and toothpaste compartment 72 also includes a rack 100 extending transversely therein. The rack 100 is adapted to releasably retain toothbrushes 102 at substantially each end thereof in a releasable fashion. The rack 100 includes a rearwardly extending horizontal ledge 104 having oppositely disposed distal ends 106. The distal ends 106 extending between the first partition 38 and the end wall 78.

To provide the desired releasable engagement between the rack 100 and the toothbrushes 102, a pair of forwardly extending gripping elements 108 are provided. Each gripping element 108 extends inwardly from a respective distal end 106 and in spaced relationship to the horizontal ledge 104. Each gripping element 108 may be flexible and fabricated from plastic material. In addition the housing 14 and reservoir 40 may also be fabricated from plastic material. In this manner the user may remove a toothbrush 102 from the rack 100 when desired and return same to the position illustrated in FIGS. 1 and 4.

Accordingly, the knob 98 which is mounted on the door 86 adjacent the free edge 110 and in spaced relationship to the hinged edge 112, permits an opening of the door 86 when desired. The door 86 is illustrated in phantom in FIG. 5 in the partially opened position thereof. A catch 114 may be provided and operatively associated with the free edge 110 to require a positive force on knob 98 for opening and closing of the door 86.

A tube of toothpaste 116 is illustrated to be contained within the compartment 72. The tube 116 is vertically positioned by mounting means 118 that is provided in compartment 72. The supporting means 118 operates in conjunction with the cap 120 of the toothpaste tube 116. The cap 120 having an upper end 122 and a lower end 124.

The supporting means 118 includes a horizontally extending plate 126 mounted in spaced relationship to the bottom wall 16. The plate 126 may be connected between the front wall 18 and the second partition 76 and above the bottom wall 16. An aperture 128 extends through the plate 126 and adapted to receive the cap 120 of the toothpaste tube 116 therein. In this manner in the upper end 122 of the cap 120 is positioned on the bottom wall 116. The aperture 128 confining the other end 124 of the cap 120 such that the tube is retained during storage thereof in the vertically extending position.

By this design, irrespective of the amount of toothpaste remaining in the tube 116, it is always properly mounted. This provides a convenience for the user of the oral hygiene device 10. The aperture 128 may extend rearwardly of the rack 100 such that the bottom 130 of the toothpaste tube 116 can extend behind the rack 100. In this manner the tube 16 is lifted out of the aperture 128 and forwardly of the opening 88 which is associated with the door 86. The supporting means 118 provides a convenient manner for using and replaceing the tube 116.

The oral hygiene device 10 further includes a pair of cup dispensers 130 that may be mounted on each end wall 22. The cup dispenser 130 retains a supply of disposable cups 132 to maintain a level of oral hygiene, so that germs are not transmitted from user to user. Although two cup dispensers 130 are illustrated, one may be used if desired.

Figure 6:
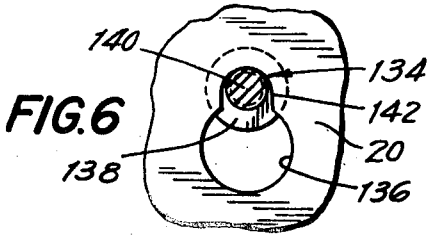
FIG. 6 is a fragmentary rear plan view taken on the line 6—6 of FIG. 4, illustrating the mounting arrangement for the unit.

Mounting means 134, as particularly illustrated in FIGS. 4 and 6 may be utilized and operatively associated with the rear wall 20 so as to permit the securement of the dispenser 10 to the wall 12. The mounting means 134 may include a cut out 136 adapted to receive the head 138 of screw 140. The screw 140 extends through a recess 142 extending outwardly from the cut out 136. In this manner the housing 14 may be rigidly mounted at a desired location on wall 12. Accordingly, the spaced apart recesses or apertures 142 are designed to withstand the load applied thereto.

Figure 7:
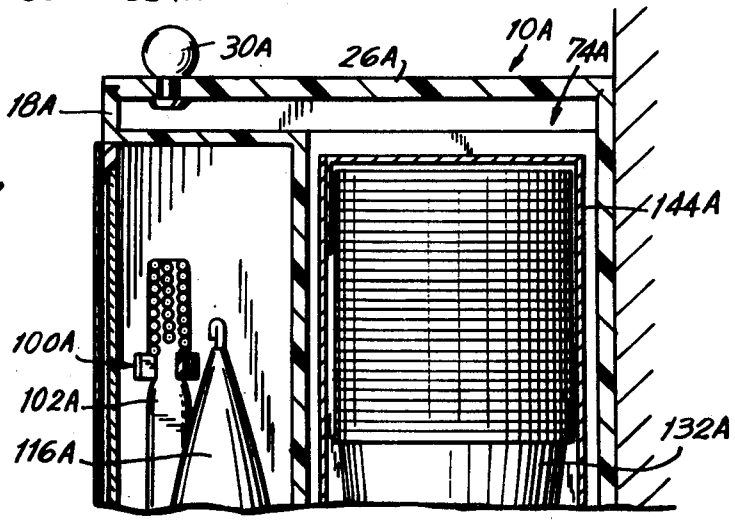
FIG. 7 is a fragmentary view similar to FIG. 3 illustrating another aspect of the present invention.
Figure 5:
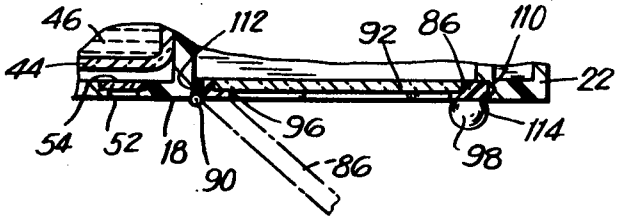
FIG. 5 is a fragmentary sectional view taken on the line 5—5 of FIG. 1.

Referring now to FIG. 7, there is depicted another embodiment of the oral hygiene dispenser 10A, wherefore similar parts are illustrated by similar reference numerals. In this embodiment the storage compartment 74A is illustrated to contain a supply of disposable cups 144A. The disposable cups 132A may be made of paper or plastic. In this manner when the cover 26A is opened access is obtained to the storage compartment 74A.

While there has been shown and described the various preferred embodiments of the present invention, it will be appreciated that the teachings herein will readily lend itself to many modifications, changes, combinations and improvements by those skilled in the art, without deviation from the present invention or the teachings hereof.

What is claimed is:

1. An oral hygiene dispenser comprising a housing having a bottom wall, oppositely disposed upstanding front and rear walls and a pair of spaced apart upstanding end walls intermediate said front wall and said rear wall, said upstanding walls joined to said bottom wall at one end thereof and terminating in an open upper end, a cover adapted to enclose said open end of said housing, a first partition in said housing extending between said front wall and said rear wall for forming a fluid compartment to dispense fluid therefrom, a viewing aperture operatively associated with said front wall in overlapping position to said fluid compartment such that the level of fluid in said fluid compartment may be immediately obtained by visual means, a spigot mounted on said front wall in communicating relationship with said fluid compartment so as to permit manual control for the dispensing of selected amounts of fluid therefrom, a second partition extending between said first partition and one of said end walls so as to obtain a toothbrush and toothpaste containing compartment adjacent said front wall and a storage compartment adjacent said rear wall, a door hingeably mounted on said front wall to gain access to said toothbrush and toothpaste compartment, a rack extending transversely across said toothbrush and toothpaste compartment, said rack adapted to releasably retain a toothbrush at substantially each end thereof, supporting means in said toothbrush and toothpaste compartment for maintaining a tube of toothpaste in a vertically extending position by means of the cap on the tube, and a cup dispenser secured to one of said end walls for retaining a supply of disposable cups, such that the user of the oral hygiene dispenser has ready access to the necessary implements required to properly maintain the oral cavity.

2. An oral hygiene device as in claim 1, wherein said cover being hingeably mounted on said rear wall for movement between a closed position to an open position in which access to said housing is obtained.

3. An oral hygiene device as in claim 2, including a lock securing said hinged cover to said front wall in said closed position of said cover.

4. An oral hygiene device as in claim 1, including a reservoir mounted in said fluid compartment for containing selected amounts of fluid, said reservoir bring transparent to permit viewing of the level of fluid therein through said viewing aperture, and said spigot extending within said reservoir so as to obtain a fluid flow therethrough.

5. An oral hygiene device as in claim 4, wherein said reservoir includes a closure removably secured to the upper end thereof to permit filling of said reservoir from time to time as required with a fluid such as a mouthwash.

6. An oral hygiene device as in claim 1, including a mirror mounted on said front wall to further facilitate use of said dispenser.

7. An oral hygiene device as in claim 1, including mounting means operatively associated with said rear wall so as to permit the securement of said dispenser to a wall.

8. An oral hygiene device as in claim 7, said mounting means including a pair of spaced apart apertures to receive a mounting screw so as to secure said housing in its wall mounted position.

9. An oral hygiene device as in claim 1, wherein said door has a transparent window therein to view the contents of said toothbrush and toothpaste compartment.

10. An oral hygiene device as in claim 9, and a knob on said door adjacent the free edge thereof in spaced relationship to the hinged edge thereof.

11. An oral hygiene device as in claim 10, and a catch operatively associated with said free edge and said front wall so as to require a positive force on said knob for opening and closing same.

12. An oral hygiene device as in claim 1, wherein said rack includes a rearwardly extending horizontal ledge having oppositely disposed distal ends, said distal ends extending between said second partition and one said end wall, and a pair of forwardly extending gripping elements extending inwardly from each of said distal ends in spaced relationship to said horizontal ledge, each of said gripping elements adapted to releasably retain a toothbrush in mounted relationship thereto.

13. An oral hygiene device as in claim 1, including another said cup dispenser secured to said opposite end wall.

14. An oral hygiene device as in claim 1, wherein said storage compartment is adapted to receive therein a container of mouthwash fluid for filling said fluid compartment.

15. An oral hygiene device as in claim 1, wherein said storage compartment is adapted to receive therein a carton of cups for use with said cup dispenser.

16. An oral hygiene device as in claim 1, wherein said supporting means comprises a horizontally extending plate in spaced relationship to said bottom wall, and an aperture in said plate adapted to receive the cap of the toothpaste tube therein, so as to support the upper end of the cap on said bottom wall with said aperture confining the other end of the cap such that the tube is retained during storage thereof in said vertically extending position.

17. An oral hygiene device as in claim 16, wherein said aperture extends rearwardly of said rack such that the bottom end of the toothpaste tube can extend behind said rack such that the tube is lifted out of said aperture and forwardly through the door for removal from said housing.

18. An oral hygiene device as in claim 1, wherein said storage compartment includes an inner liner with a lid adapted to be opened to gain access to said liner.

19. An oral hygiene device as in claim 1, wherein said cover has a handle thereon.

20. An oral hygiene dispenser comprising a housing having a bottom wall, oppositely disposed upstanding front and rear walls and a pair of spaced apart upstanding end walls intermediate said front wall and said rear wall, said upstanding walls joined to said bottom wall at one end thereof and terminating in an open upper end, a cover adapted to enclose said open end of said housing, said cover being hingeably mounted on said rear wall for movement between a closed position to an open position in which access to said housing is obtained, a first partition in said housing extending between said front wall and said rear wall for forming a fluid compartment, a reservoir mounted in said fluid compartment for containing selected amounts of fluid, a viewing aperture operatively associated with said front wall in overlapping position to said fluid compartment such that the level of fluid in said reservoir may be immediately obtained by visual means, said reservoir bring transparent to permit viewing of the level of fluid therein through said viewing aperture, a spigot mounted on said front wall in communicating relationship with said reservoir so as to permit manual control for the dispensing of selected amounts of fluid therefrom, a second partition extending between said first partition and one of said end walls so as to obtain a toothbrush and toothpaste containing compartment adjacent said front wall and a storage compartment adjacent said rear wall, a door hingeably mounted on said front wall to gain access to said toothbrush and toothpaste compartment, said door having a transparent window therein to view the contents of said toothbrush and toothpaste compartment, a rack extending transversely across said toothbrush and toothpaste compartment, said rack adapted to releasably retain a toothbrush at substantially each end thereof, said rack comprising a rearwardly extending horizontal ledge having oppositely disposed distal ends, said distal ends extending between said first partition and one said end wall, and a pair of forwardly extending gripping elements extending inwardly from each of said distal ends in spaced relationship to said horizontal ledge, each of said gripping elements adapted to releasably retain a toothbrush in mounted relationshp thereto, supporting means in said toothbrush and toothpaste compartment for maintaining a tube of toothpaste in a vertically extending position by means of the cap on the tube, said supporting means comprises a horizontally extending plate in spaced relationship to said bottom wall having an aperture in said plate adapted to receive the cap of the toothpaste tube therein, so as to support the upper end of the cap on said bottom wall with said aperture confining the other end of the cap such that the tube is retained during storage thereof in said vertically extending position, a cup dispenser secured to one of said end walls for retaining a supply of disposable cups, such that the user of the oral hygiene dispenser has ready access to the necessary implements required to properly maintain the oral cavity, and mounting means operatively associated with said rear wall so as to permit the securement of said dispenser to a wall.

21. An oral hygiene device as in claim 20, including a lock securing said hinged cover to said front wall in said closed position of said cover.

22. An oral hygiene device as in claim 20, wherein said reservoir includes a closure removably secured to the upper end thereof to permit filling of said reservoir from time to time as required with a fluid such as a mouthwash.

23. An oral hygiene device as in claim 20, including a mirror mounted on said front wall to further facilitate use of said dispenser.

24. An oral hygiene device as in claim 20, said mounting means including a pair of spaced apart apertures to receive a mounting screw so as to secure said housing in its wall mounted position.

25. An oral hygiene device as in claim 20, and a knob on said door adjacent the free edge thereof in spaced relationship to the hinged edge thereof.

26. An oral hygiene device as in claim 25, and a catch operatively associated with said free edge and said front wall so as to require a positive force on said knob for opening and closing same.

27. An oral hygiene device as in claim 20, including another said cup dispenser secured to said opposite end wall.

28. An oral hygiene device as in claim 20, wherein said storage compartment is adapted to receive therein a container of mouthwash fluid for filling said reservoir.

29. An oral hygiene device as in claim 20, wherein said storage compartment is adapted to receive therein a carton of cups for use with said cup dispenser.

30. An oral hygiene device as in claim 20, wherein said aperture extending rearwardly of said rack such that the bottom end of the toothpaste tube can extend behind said rack, such that the tube is lifted out of said aperture and forwardly through the opening of said door for removal from said housing.

31. An oral hygiene device as in claim 20, wherein said storage compartment includes an inner liner with a lid adapted to be opened to gain access to said liner.

32. An oral hygiene device as in claim 20, wherein said cover has a handle thereon.

33. An oral hygiene dispenser comprising a housing having a bottom wall, oppositely disposed upstanding front and rear walls and a pair of spaced apart upstanding end walls intermediate said front wall and said rear wall, said upstanding walls terminating in an open upper end, a cover adapted to enclose said open end of said housing, a fluid compartment in said housing to dispense fluid therefrom, a spigot mounted on said front wall in communicating relationship with said fluid compartment so as to permit manual control for the dispensing of selected amounts of fluid therefrom, a toothbrush and toothpaste containing compartment in said housing adjacent said front wall, a storage compartment in said housing adjacent said rear wall, a door hingeably mounted on said front wall to gain access to said toothbrush and toothpaste compartment, a rack extending transversely across said toothbrush and toothpaste compartment, said rack adapted to releasably retain at least one toothbrush, supporting means in said toothbrush and toothpaste compartment for maintaining a tube of toothpaste in a vertically extending position, and a cup dispenser secured to one of said end walls for retaining a supply of disposable cups, such that the user of the oral hygiene dispenser has ready access to the necessary implements required to properly maintain the oral cavity.

34. An oral hygiene device as in claim 33, including a viewing aperture operatively associated with said front wall in overlapping position to said fluid compartment such that the level of fluid in said fluid compartment may be immediately obtained by visual means.

35. An oral hygiene device as in claim 34, including a reservoir mounted in said fluid compartment for containing selected amounts of fluid, said reservoir being transparent to permit viewing of the level of fluid therein through said viewing aperture, said spigot extending within said reservoir so as to obtain a fluid flow therethrough, and said reservoir includes a closure removably secured to the upper end thereof to permit filling of said reservoir from time to time as required with a fluid such as a mouthwash.

36. An oral hygiene device as in claim 33, wherein said cover being hingeably mounted on said rear wall for movement between a closed position to an open position in which access to said housing is obtained, and including a lock securing said hinged cover to said front wall in said closed position of said cover.

37. An oral hygiene device as in claim 33, wherein said rack includes a rearwardly extending horizontal ledge having oppositely disposed distal ends, said distal ends extending between spaced apart ends of said toothbrush and toothpaste compartment, and a pair of forwardly extending gripping elements extending inwardly from each of said distal ends in spaced relationship to said horizontal ledge, each of said gripping elements adapted to releasably retain a toothbrush in mounted relationship thereto.

38. An oral hygiene device as in claim 37, including another said cup dispenser secured to said opposite end wall.

39. An oral hygiene device as in claim 37, wherein said supporting means comprises a horizontally extending plate in spaced relationship to said bottom wall, and an aperture in said plate adapted to receive the cap of the toothpaste tube therein, so as to support the upper end of the cap on said bottom wall with said aperture confining the other end of the cap such that the tube is retained during storage thereof in said vertically extending position.

40. An oral hygiene device as in claim 39, wherein said aperture extends rearwardly of said rack such that the bottom end of the toothpaste tube can extend behind said rack such that the tube is lifted out of said aperture and forwardly through the door for removal from said housing.

* * * * *